US007898791B2

(12) United States Patent
Sato et al.

(10) Patent No.: US 7,898,791 B2
(45) Date of Patent: Mar. 1, 2011

(54) IONIZER WITH DROP-OFF PREVENTION DEVICE FOR ELECTRODE

(75) Inventors: Toshio Sato, Tsukubamirai (JP); Satoshi Suzuki, Tsukubamirai (JP); Gen Tsuchiya, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 1110 days.

(21) Appl. No.: 11/564,601

(22) Filed: Nov. 29, 2006

(65) Prior Publication Data

US 2007/0126363 A1 Jun. 7, 2007

(30) Foreign Application Priority Data

Dec. 5, 2005 (JP) ..... 2005-351246

(51) Int. Cl.
*H01T 23/00* (2006.01)
*B03C 3/40* (2006.01)

(52) U.S. Cl. ..... 361/231; 96/83

(58) Field of Classification Search ..... 361/231; 96/83

See application file for complete search history.

(56) References Cited

U.S. PATENT DOCUMENTS 4,741,746 A * 5/1988 Chao et al. ..... 96/43
7,465,340 B2 * 12/2008 Sato et al. ..... 96/83
7,497,898 B2 * 3/2009 Sato et al. ..... 96/43
2008/0098895 A1 * 5/2008 Sato et al. ..... 96/54
2008/0130190 A1 * 6/2008 Shimada ..... 361/231
2009/0135537 A1 * 5/2009 Yasuoka et al. ..... 361/213

FOREIGN PATENT DOCUMENTS

JP 2005-108829 4/2005

OTHER PUBLICATIONS

U.S. Appl. No. 11/877,269, filed Oct. 23, 2007, Sato, et al.
U.S. Appl. No. 12/015,010, filed Jan. 16, 2008, Sato, et al.

* cited by examiner

*Primary Examiner*—Ronald W Leja
(74) *Attorney, Agent, or Firm*—Oblon, Spivak, McClelland, Maier & Neustadt, L.L.P.

(57) ABSTRACT

In an ionizer, in which an electrode cartridge having a pair of electrodes is mounted in an electrode-attaching opening of a housing so as to be freely attached and detached by means of rotating the same around a center axial line, a drop-off prevention cover is attached to the housing. In the drop-off prevention cover, a fitting hole, to which the electrode cartridge is fitted, is formed, and by means of limiting a rotation of the electrode cartridge by the fitting hole, the electrode cartridge is prevented from dropping off.

10 Claims, 7 Drawing Sheets

IONIZER WITH DROP-OFF PREVENTION DEVICE FOR ELECTRODE

TECHNICAL FIELD

The present invention relates to an ionizer for use in a discharge for a charged workpiece, and more in detail, to an ionizer provided with a drop-off prevention device for preventing dropping off of an electrode for ion generation.

BACKGROUND ART

In a treating process for a workpiece such as a semiconductor wafer or the like, an ionizer is used for discharging the workpiece being electrostatically charged. The ionizer is constructed such that a positive electrode and a negative electrode are disposed in an electrode-attaching opening at a lower surface of a housing, and a positive pulsing high voltage is applied to the positive electrode and a negative pulsing high voltage is applied to the negative electrode, as shown, for example, in the patent document 1, and thereby a corona discharge is generated so as to generate a positive ion and a negative ion from both electrodes.

The positive and negative electrodes tend to have a stain due to adhesion of dust and tend to be worn by repetition of the corona discharge. Therefore, this requires frequent cleaning and exchange of the positive and negative electrodes, and the same are detachably constructed. That is, an electrode cartridge is formed by holding a pair of the electrodes by a hollow electrode holder, and the electrode cartridge is configured to be detachably attached to the housing. The attaching method is generally configured such that the electrode cartridge is fit into the electrode-attaching opening formed in the housing, and by means of rotating the electrode cartridge by a certain angle around a center axial line thereof, an attaching projection formed in the electrode cartridge is latched to an attaching concave portion formed in the housing.

However, in this kind of ionizer, the aforementioned electrode cartridge is gradually rotated by vibration, a shock, or the like caused when in use, and there is a possibility that the projection finally drops off from the concave portion and that the same is dropped off from the electrode-attaching opening. Accordingly, so as for the electrode cartridge not to be dropped off from the housing, it is required to configure an attaching operation for the electrode cartridge to be further assured.

Patent Document 1: Japanese Unexamined Patent Application Publication No. 2005-108829

DISCLOSURE OF INVENTION

Accordingly, an object of the present invention is to provide an ionizer provided with a drop-off prevention device for an electrode for preventing the electrode cartridge from dropping off.

So as to achieve the object, the ionizer according to the present invention includes a housing having a lower surface where an electrode-attaching opening is opened, and both side surfaces continuing into the lower surface, an electrode cartridge detachably attached into the electrode-attaching opening, and a drop-off prevention cover attached to the housing, for preventing the electrode cartridge from dropping off. The electrode cartridge is formed by means of causing a hollow electrode holder having an elliptic cross-section to hold a pair of electrodes, and is free to be engaged with and disengaged from the aforementioned housing by means of being rotated around a center axial line in the electrode-attaching opening. Further, the drop-off prevention cover is detachably attached to the housing and is provided with a restraining portion for restraining the electrode cartridge. The drop-off prevention cover is constructed so as to prevent the electrode cartridge from dropping off by means of limiting a rotation of the electrode cartridge by the restraining portion.

In the present invention, it is desirable to cause the ellipse-shaped fitting hole, where the electrode cartridge is fitted into, to serve as the restraining portion of the drop-off prevention cover.

In the present invention, preferably, the drop-off prevention cover has a groove-shaped cross-section and includes the fitting hole at a bottom wall portion thereof, and is attached to the lower surface of the housing in a condition of straddling the lower surface.

In this case, it is preferable that the housing includes a pair of attaching grooves extending in a longitudinal direction of the housing at positions situated nearer the lower surface at a lower end of the both side faces, and the drop-off prevention cover is constructed such that the left and right side walls are elastically deformable in an opening and closing direction of both of the same, and is provided with a projecting edge inwardly projecting at a tip end of each of the left and right side walls, and the drop-off prevention cover is attached to the housing by means of elastically latching the projecting edge to the pair of the attaching grooves.

Further, in the present invention, the drop-off prevention cover may include a latch arm latching the side surface or an upper surface of the housing, while extending upward from the left and right side walls.

Alternatively, the drop-off prevention cover may be attached to the housing with a band surrounding the drop-off prevention cover and the housing.

Furthermore, the drop-off prevention cover can also be attached to the housing with a screw.

Moreover, in the present invention, the drop-off prevention cover can also be caused to have a function as a filter holder at the same time by means of providing a filter for covering an opening portion at a tip end of the electrode holder in the electrode cartridge, in the fitting hole of the aforementioned drop-off prevention cover.

According to the present invention, the electrode cartridge can assuredly be prevented from dropping off by means of applying a simple technological device such as that the drop-off prevention cover is detachably attached to the housing of the ionizer, and that the rotation of the electrode cartridge is limited by means of the drop-off prevention cover.

BEST MODE FOR CARRYING OUT THE INVENTION

Figure 1:
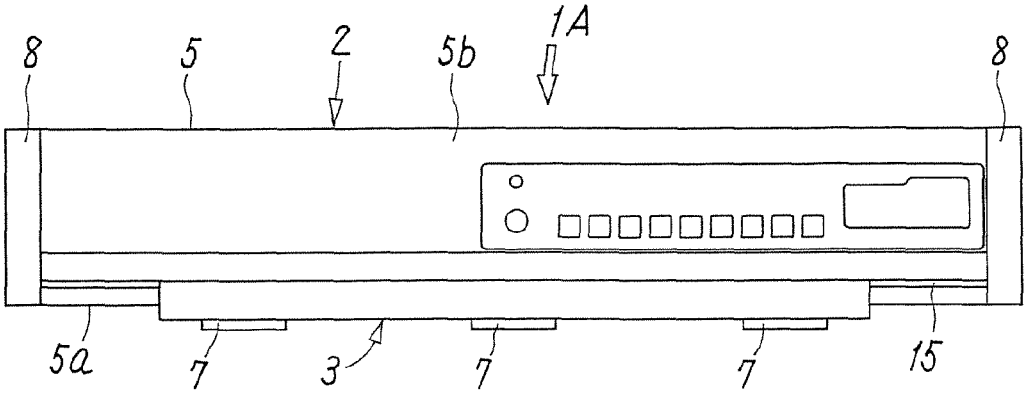
FIG. 1 is an elevation showing the first embodiment of an ionizer with respect to the present invention.
Figure 2:
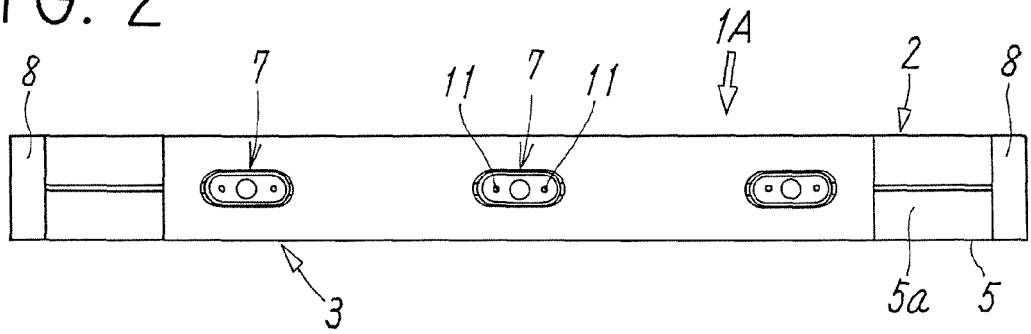
FIG. 2 is a bottom view of FIG. 1.
Figure 3:
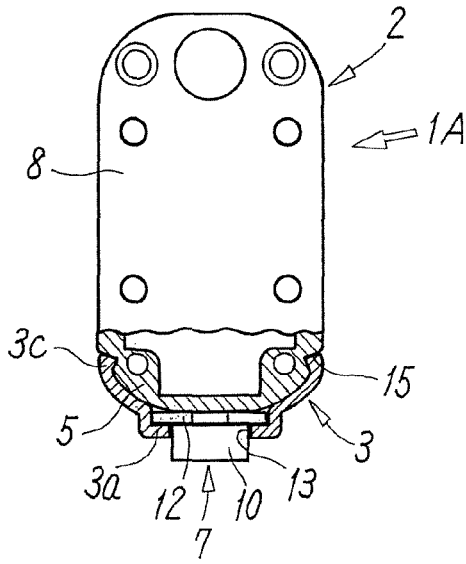
FIG. 3 is a side view of FIG. 1 showing in a partially broken condition.
Figure 4:
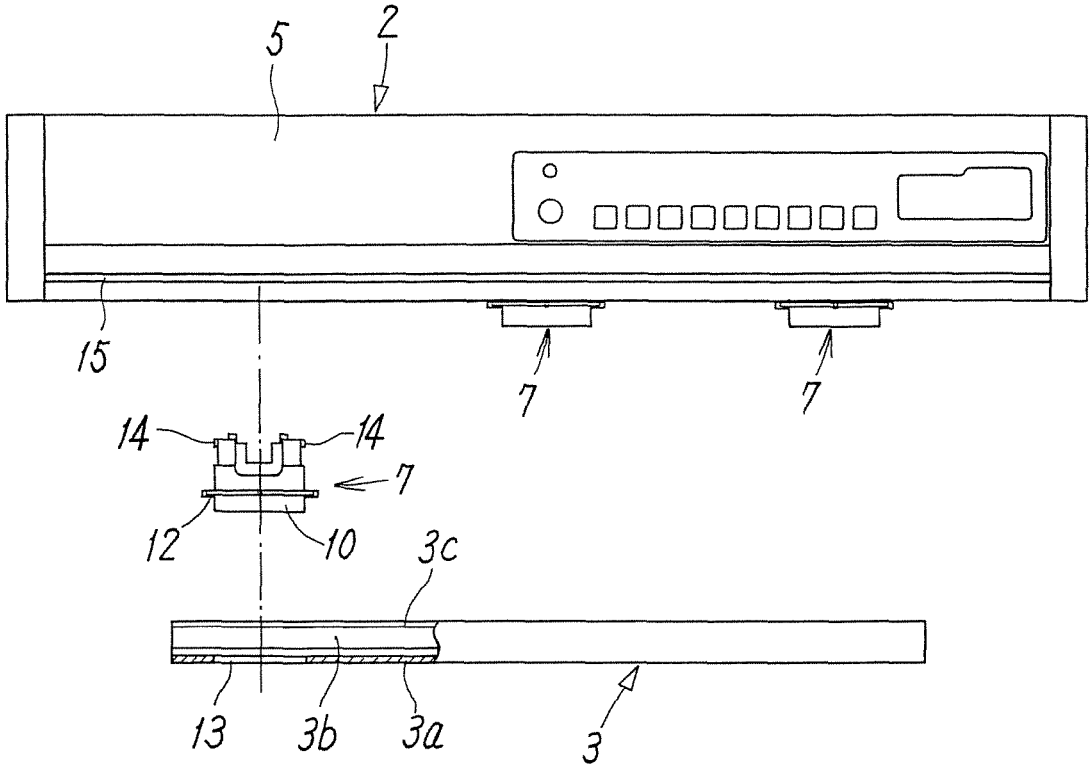
FIG. 4 is an exploded view of FIG. 1 showing a drop-off prevention cover in a partially broken condition.

FIG. 1 through FIG. 5 are views showing the first embodiment of an ionizer with respect to the present invention. The ionizer 1A is used for discharging a workpiece being electrostatically charged during a treating process for the workpiece such as a semiconductor wafer or the like. When positive and negative ions are projected to the workpiece from the ionizer 1A, the negative ion is absorbed in a case that the workpiece is charged to a positive potential, and the positive ion is absorbed in a case that the workpiece is charged to a negative potential, and the discharging operation is thereby performed.

The ionizer 1A is the one in which a drop-off prevention cover 3 for preventing electrodes from dropping off is detachably attached to an ionizer main body 2 provided with a pair of or more positive and negative electrodes, 11 and 11, preferably, a plurality of pairs of the same for generating the ions.

The ionizer main body 2 includes a laterally thin and long hollow housing 5. The housing 5 has a cross-sectional shape of a longitudinally long rectangle, that of an elliptic shape, or that similar to the same. A plurality of electrode-attaching openings 6 having a thin and long elliptic shape in an axial direction (longitudinal direction) is formed at a lower surface 5*a* of the housing 5 at even intervals in the axial direction. Further, an electrode cartridge 7 is detachably attached to each of electrode-attaching openings 6. A numeral 8 in the drawings denotes an end plate for obstructing both end portions in a longitudinal direction of the housing 5.

Figure 6:
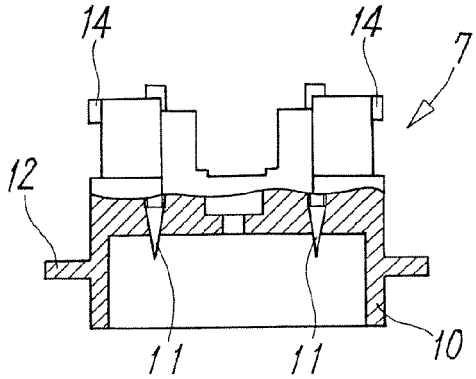
FIG. 6 is a partial cross-section of an electrode cartridge.

The electrode cartridge 7 is the one, in which a positive and negative pair of the electrodes, 11 and 11 for generating the positive and negative ions by means of applying a high voltage is held in an internal part of a hollow electrode holder 10 having an elliptic cross-section, as is clear from FIG. 6. A latch portion 12 having a flange like shape, to be latched to the electrode-attaching opening 6 and a fitting hole 13 of the drop-off prevention cover 3 is provided around a periphery of a middle portion of the electrode holder 10. Further, attaching projections, 14 and 14, for latching the electrode cartridge 7 to an inner part of the electrode-attaching opening 6 are formed at both end portions in a longitudinal direction of an ellipse at a base end portion of the electrode holder 10.

The electrode holder 10 is formed such that dimensions in a long side direction and a short side direction of the ellipse are sufficiently smaller than that of a long side direction and a short side direction of the ellipse of the electrode-attaching opening 6 so that the electrode holder 10 can be fitted into the electrode-attaching opening 6 with sufficient margin. On the other hand, the latch portion 12 is formed such that dimensions of a long side direction and a short side direction of the latch portion 12 are larger than that of the long side direction and the short side direction of the electrode-attaching opening 6 so that the latch portion 12 is latched to an opening edge of the electrode-attaching opening 6 when the electrode holder 10 is fitted into the electrode-attaching opening 6.

Figure 7:
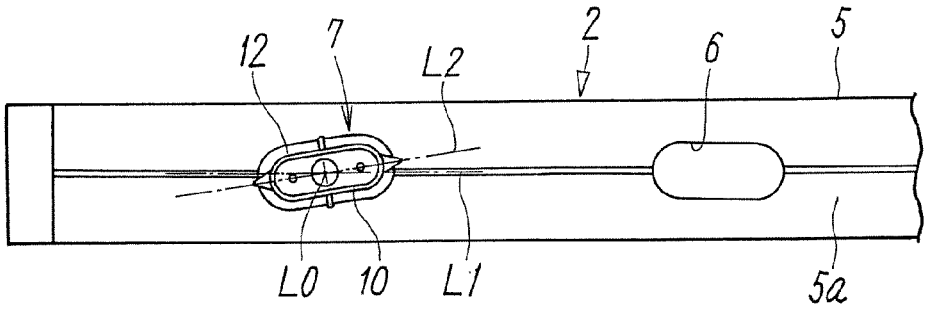
FIG. 7 is a bottom view of a part of an ionizer main body.
Figure 8:
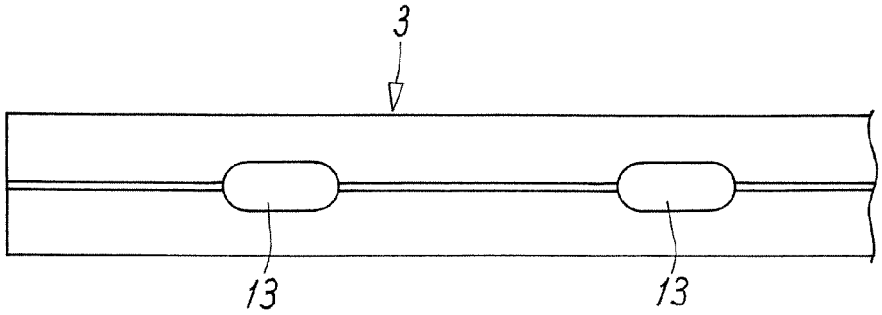
FIG. 8 is a partial bottom view of the drop-off prevention cover.

Further, as shown in FIG. 7, the electrode cartridge 7 is fitted into the electrode-attaching opening 6 in a slanting condition, that is, an axial line L2 in a long side direction of the ellipse of the electrode holder 10 is slanted in relation to an axial line L1 in the long side direction of the ellipse of the electrode-attaching opening 6. Thereafter, the electrode cartridge 7 is rotated by a certain angle around a center axial line LO, and the axial line L2 in the long side direction is conformed to the axial line L1 in the long side direction of the electrode-attaching opening 6. Thereby, the attaching projection 14 is latched to an attaching concave portion (not shown) of the housing 5, and the electrode cartridge 7 is configured to be attached to the electrode-attaching opening 6.

When the cartridge 7 is detached from the electrode-attaching opening 6, the electrode cartridge 7 is rotated up to a position where the axial line L2 in the long side direction of the electrode holder 10 is slanted in relation to the axial line L1 in the long side direction of the electrode-attaching opening 6. Thereby, the attaching projection 14 is removed from the attaching concave portion of the housing 5. As a result, the electrode cartridge 7 can be detached.

The aforementioned positive and negative electrodes, 11 and 11, are, although not shown, connected to a positive high-voltage generating circuit for generating a positive pulsing high voltage, and a negative high-voltage generating circuit for generating a negative pulsing high voltage, respectively. The positive and negative electrodes, 11 and 11, generate corona discharges by means of that the positive and negative high voltages are alternately applied from these periodically operating high-voltage generating circuits. The positive ion is discharged from the positive electrode 11 and the negative ion is discharged from the negative electrode 11. These high-voltage generating circuits and controllers therefore may be provided in an internal part of the housing 5 or may be provided at an appropriate position of an external part of the housing 5.

Figure 5:
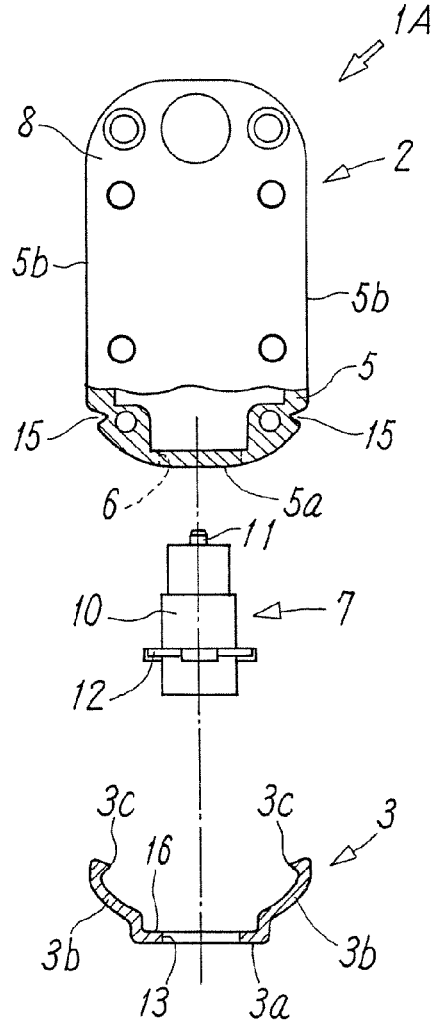
FIG. 5 is a side view of FIG. 4 showing in a partially broken condition.
Figure 9:
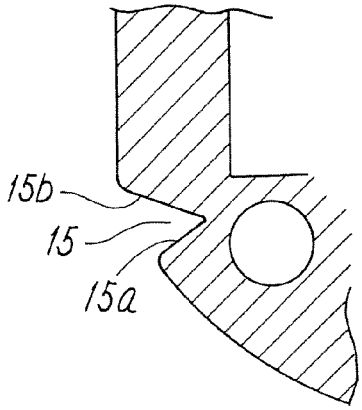
FIG. 9 is an enlarged partial cross-section of a housing.

Further, the housing 5 is, as clear from FIG. 5, provided with left and right side surfaces 5*b* and 5*b*, continuing into the lower surface 5*a*, and a pair of attaching grooves, 15 and 15 extending across an entire length in an axial direction (longitudinal direction) of the housing 5 at a position facing each other that are situated nearer the lower surface 5*a* located at a lower end of these side surfaces, 5*b* and 5*b*. Although the cross-section of the attaching groove 15 may have any of the shapes, such as a V-shape, a U-shape, a concave shape, or the like, in an example shown in the drawing, the same is formed into a V-shape, as shown in FIG. 9, and a lower side groove wall 15*a* of the attaching groove 15 is slanted in a manner so as to be gradually lowered toward outside in a direction of a groove opening side. Furthermore, a height from a groove bottom to the groove opening at the lower side groove wall 15*a* is formed to be smaller in relation to a height from a groove bottom to a groove opening at an upper side groove wall 15*b*.

The drop-off prevention cover 3 is formed to have a groove cross-section with a transparent material or an opaque material having elasticity, such as synthetic resin, or the like. The drop-off prevention cover 3 is provided with a substantially flat bottom wall 3*a*, left and right side walls, 3*b* and 3*b*, extending upward while being slanted or curved in a manner that the more the left and right side walls, 3*b* and 3*b*, extend, the larger the distance between the side walls, 3*b* and 3*b*, becomes, after once rising upward from both left and right side end portions of the bottom wall 3*a*, and projecting edges, 3*c* and 3*c*, for latching, which are formed in a manner so as to be inwardly protruding at upper end portions of both the side walls, 3*b* and 3*b*. At the bottom wall 3*a*, as is clear from FIG.

8, the fitting hole 13 having an elliptic shape, to which the electrode holder 10 of the electrode cartridge 7 is fitted, is formed in the same number as that of the electrode cartridge 7 in the longitudinal direction of the drop-off prevention cover 3 at predetermined intervals. Further, the left and right side walls, 3*b* and 3*b*, are constructed to be elastically deformable in a direction in which the distance between each other is widened or narrowed, and by means of elastically latching the projecting edges, 3*c* and 3*c*, at tip ends of both the side walls, 3*b* and 3*b*, to the attaching grooves, 15 and 15, the drop-off prevention cover 3 is attached to the lower surface 5*a* of the housing 5 in a manner so as to be detachable in a condition that the drop-off prevention cover 3 is straddling the lower surface 5*a*.

In a condition that the drop-off prevention cover 3 is attached to the lower surface 5*a* of the housing 5, the electrode holder 10 of the electrode cartridge 7 is fitted into the fitting hole 13, and the tip end thereof is slightly protruded downward from the drop-off prevention cover 3. Further, the latch portion 12 having the flange like shape formed on the electrode holder 10 is in contact with a hole edge of the fitting hole 13 from inside of the drop-off prevention cover 3. Accordingly, the hole edge of the fitting hole 13 is configured to form a latch-receiving portion 16 where the latch portion 12 is in contact therewith and is latched thereto.

The fitting hole 13 has a size in which the electrode holder 10 can be fitted via a slight gap therebetween. In other words, dimensions of the long side direction and short side direction of the fitting hole 13 are formed in an extent to be slightly larger in comparison with the electrode holder 10, and a rotation of the electrode cartridge 7 is limited by means of the fitting hole 13. Accordingly, the fitting hole 13 is configured to form a restraining portion for limiting the rotation of the electrode cartridge 7 while restraining the same.

Thus, resulting from that the rotation of the electrode cartridge 7 is limited by mans of the drop-off prevention cover 3, the attaching projection 14 of the electrode cartridge 7 is prevented from being removed from the attaching concave portion of the housing 5. Therefore, there is no possibility that the electrode cartridge 7 drops off from the electrode-attaching opening 6. In addition, by means of that the latch portion 12 is latched to the hole edge of the fitting hole 13, while being in contact with the same, the effect of drop-off prevention is further assured.

When the electrode cartridge 7 is detached from the electrode-attaching opening 6, the detaching operation is enabled by means of rotating the electrode cartridge 7 around the center axial line L0 by a certain angle after detaching the drop-off prevention cover 3 from the housing 5, and removing the attaching projection 14 from the latched condition thereof to the attaching concave portion of the housing 5.

It is preferable that the drop-off prevention cover 3 has a lateral width not to be protruded outward from the side surfaces, 5*b* and 5*b*, of the housing 5, when the drop-off prevention cover 3 is attached to the housing 5, and more preferably, the drop-off prevention cover 3 has the same lateral width as that of the housing 5.

Further, although the length of the drop-off prevention cover 3 can be formed to be the same length as that of the housing 5 so that the drop-off prevention cover 3 entirely covers the lower surface 5*a* of the housing 5, the length of the drop-off prevention cover 3 is formed to be shorter than that of the housing 5, while the drop-off prevention cover 3 is formed to have the length such as that the drop-off prevention cover 3 straddles across all the electrode cartridges 7, in the embodiment shown in the drawings. Thereby, other parts such as a sensor or the like can be attached to the ionizer main body 2 with a material having a latching side wall and a projecting edge similar to that of the drop-off prevention cover 3, by utilizing a part of the attaching grooves, 15 and 15.

Figure 10:
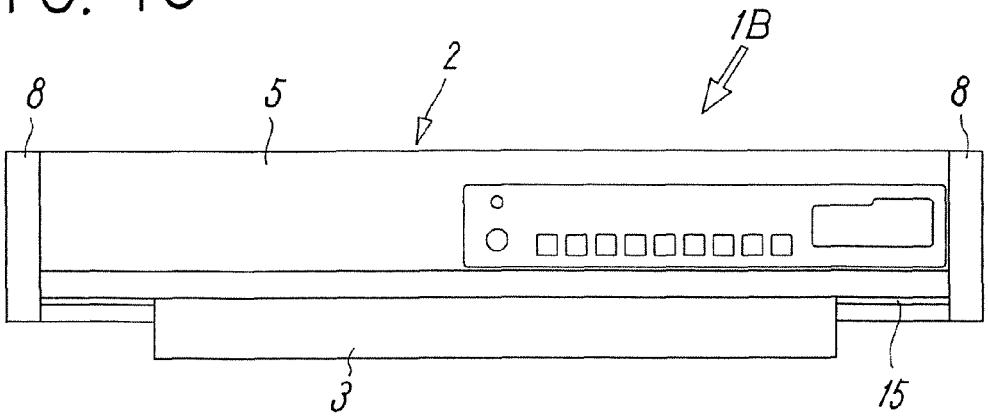
FIG. 10 is an elevation of the second embodiment with respect to the present invention.
Figure 11:
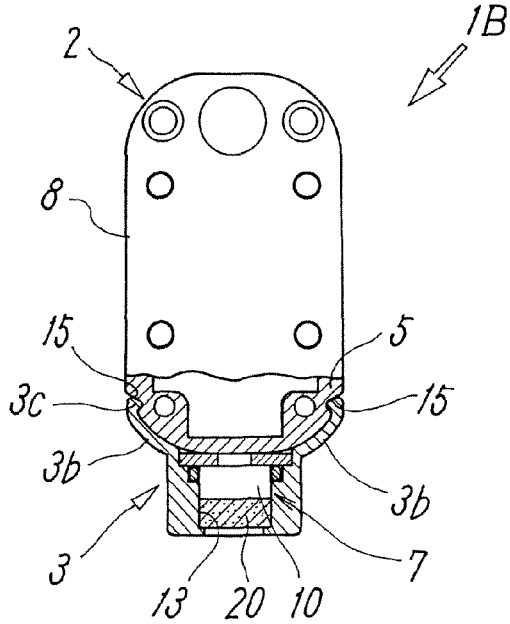
FIG. 11 is a side view of FIG. 10 showing in a partially broken condition.

FIG. 10 and FIG. 11 show the second embodiment of the present invention, and the ionizer 1B in the second embodiment is constructed for the drop-off prevention cover 3 to have a function as a filter holder at the same time. That is, the fitting hole 13 of the drop-off prevention cover 3 is formed to have a depth for a tip end portion of the electrode holder 10 of the electrode cartridge 7 not to be protruded, and a spongy filter 20 for covering an opening portion of a tip end of the electrode holder 10 is housed in the fitting hole 13.

Since the construction of the second embodiment other than that of the above-described is substantially similar to that of the first embodiment, the same numerals as that in the case of the first embodiment are attached to the same main components of the second embodiment, and the explanation is omitted.

Figure 12:
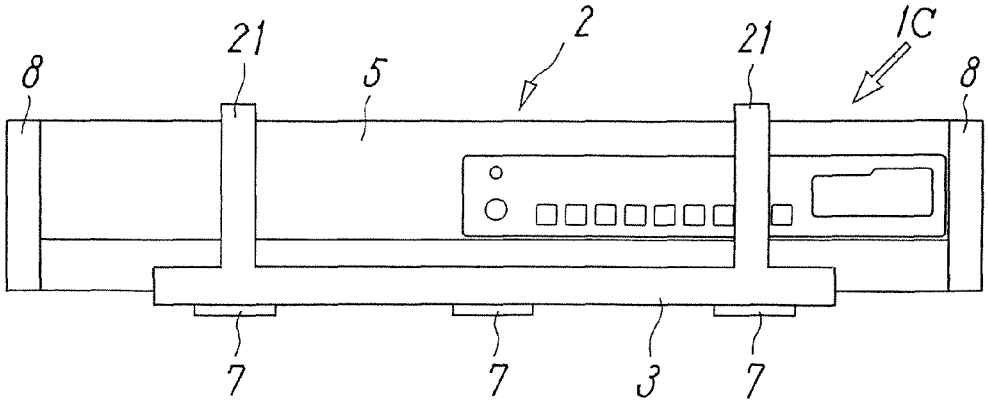
FIG. 12 is an elevation of the third embodiment with respect to the present invention.
Figure 13:
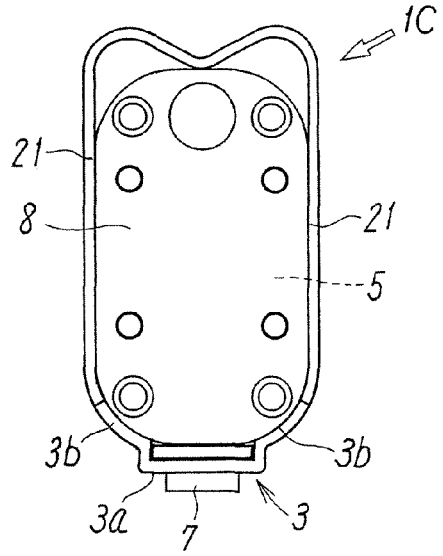
FIG. 13 is a side view of FIG. 12.

FIG. 12 and FIG. 13 are showing the third embodiment of the present invention, and a point of difference of an ionizer 1C of the third embodiment from the ionizers, 1A and 1B in the first and the second embodiment is that the drop-off prevention cover 3 is integrally provided with a plurality of latch arms 21 having a belt like shape upwardly extending from the left and right side walls, 3*b* and 3*b*, and the latch arm 21 is attached to the housing 5 by means of being latched to the upper surface of the housing 5.

Accordingly, there is no need to form the attaching grooves, 15 and 15, in the housing 5 as in the first and second embodiments, and further, there is also no need to form the projecting edges, 3*c* and 3*c*, to be latched to the attaching grooves, 15 and 15, on both side walls, 3*b* and 3*b*, of the drop-off prevention cover 3. However, in the housing 5, the attaching grooves, 15 and 15, may be formed so that other parts such as the sensor and the like are attached.

Although it is desirable that the drop-off prevention cover 3 and the latch arm 21 are transparent, the same may be opaque. Furthermore, although the latch arm 21 continues in a ring like shape, the same may be divided into left and right parts. In a case that the latch arm 21 is divided, it may be applicable that a projection is provided at a tip end of the left and right latch arms, 21 and 21, and the projection is latched to a concave portion or the like formed in the side surface 5*b* of the housing 5.

Figure 14:
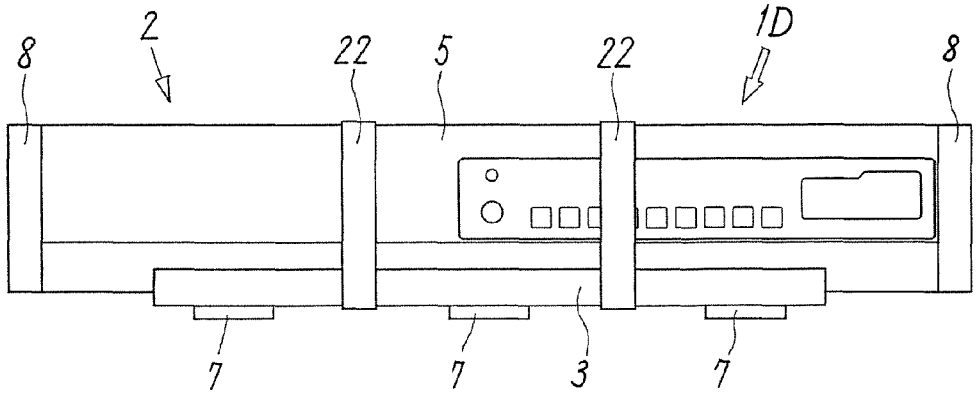
FIG. 14 is an elevation of the fourth embodiment with respect to the present invention.
Figure 15:
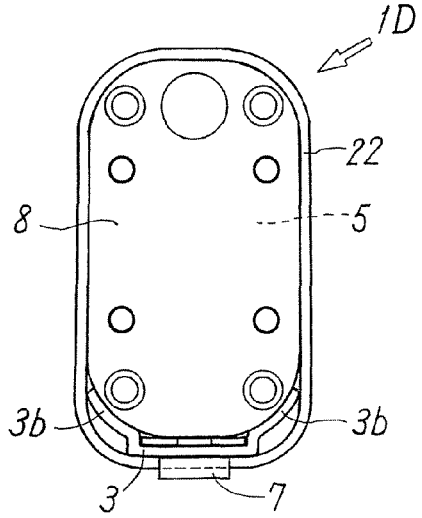
FIG. 15 is a side view of FIG. 14.

FIG. 14 and FIG. 15 are showing the fourth embodiment of the present invention, and a point of difference of the ionizer 1D of the fourth embodiment from the ionizer 1C of the third embodiment is that the drop-off prevention cover 3 is attached to the housing 5 with a plurality of bands 22 that are separately formed from the drop-off prevention cover 3. These bands 22 are disposed in a manner so as to be entirely surrounding the drop-off prevention cover 3 and the housing 5. The construction other than that of the above-described is substantially the same as that of the third embodiment.

Figure 16:
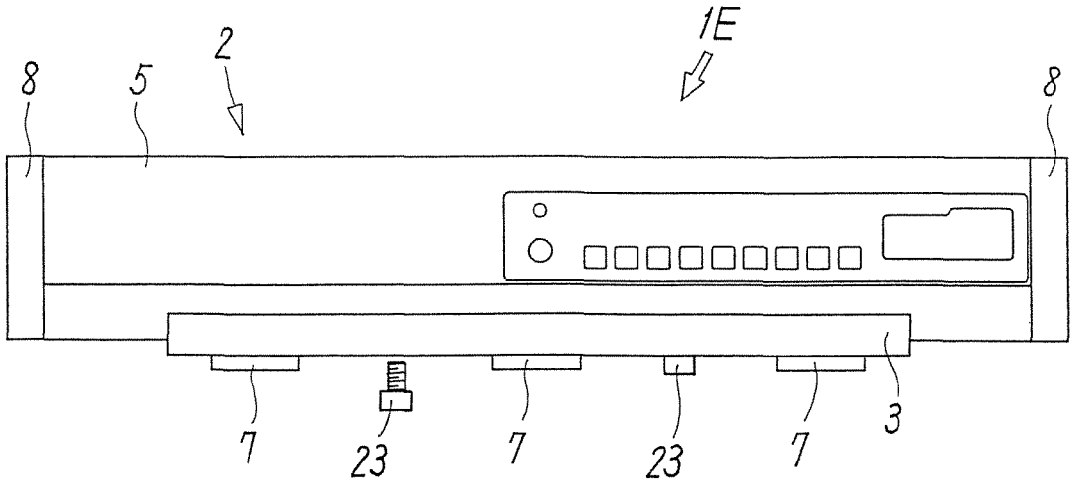
FIG. 16 is an elevation showing the fifth embodiment with respect to the present invention in a condition in which a part of screws are removed.

FIG. 16 is showing the fifth embodiment of the present invention and an ionizer 1E of the fifth embodiment uses a screw 23 instead of the band 22 in the fourth embodiment, and the drop-off prevention cover 3 is attached to the housing 5 with the screw 23. The construction other than that of the above-described is substantially the same as that in the fourth embodiment.

Incidentally, although one drop-off prevention cover 3 having a length that enables the same to straddle across all the electrode cartridges 7 is attached to the ionizer main body 2 in each of the embodiments, the drop-off prevention cover 3 may be divided into each of individual electrode cartridges 7. Alternatively, in a case that the number of the electrode cartridge 7 is large, a plurality of drop-off prevention covers 3 each having a length to straddle across a plurality of electrode cartridges 7 may be used.

The invention claimed is:

1. An ionizer with drop-off prevention device for electrode comprising:

a housing having a lower surface where an electrode-attaching opening is opened, and side surfaces both continuing into the lower surface;

an electrode cartridge detachably attached into the electrode-attaching opening; and a drop-off prevention cover attached to the housing, for preventing the electrode cartridge from dropping off, wherein the electrode cartridge is formed by means of causing a hollow electrode holder having an elliptic cross-section to hold a pair of electrodes, and is free to be engaged with and disengaged from the housing by means of being rotated around a center axial line in the electrode-attaching opening, and wherein the drop-off prevention cover is detachably attached to the housing and is provided with a restraining portion for restraining the electrode cartridge, and wherein the drop-off prevention cover is constructed so as to prevent the electrode cartridge from dropping off by means of limiting a rotation of the electrode cartridge by the restraining portion.

2. The ionizer according to claim 1, wherein the restraining portion of the drop-off prevention cover is a fitting hole having an elliptic shape, into which the electrode cartridge is fitted.

3. The ionizer according to claim 2, wherein the drop-off prevention cover has a groove-shaped cross-section and is provided with the fitting hole at a bottom wall portion, and wherein the drop-off prevention cover is attached to the lower surface of the housing in a condition of straddling the lower surface.

4. The ionizer according to claim 3, wherein the housing includes a pair of attaching grooves extending in a longitudinal direction of the housing at positions situated nearer the lower surface at a lower end of the both side faces, and wherein the drop-off prevention cover is constructed such that left and right side walls are elastically deformable in an opening and closing direction of both of the same, and is provided with a projecting edge inwardly projecting at a tip end of each of the left and right side walls, and wherein the drop-off prevention cover is attached to the housing by means of elastically latching the projecting edge to the pair of attaching grooves.

5. The ionizer according to claim 1, wherein the drop-off prevention cover includes a latch arm upwardly extending from left and right side walls and to be latched to the side surface or an upper surface of the housing.

6. The ionizer according to claim 1, wherein the drop-off prevention cover is attached to the housing by means of a band surrounding the drop-off prevention cover and the housing.

7. The ionizer according to claim 1, wherein the drop-off prevention cover is attached to the housing with a screw.

8. The ionizer according to claim 1, wherein the drop-off prevention cover is caused to have a function as a filter holder at the same time by means of providing a filter for covering an opening portion at a tip end of the electrode holder in the electrode cartridge, in a fitting hole of the drop-off prevention cover.

9. The ionizer according to claim 2, wherein the drop-off prevention cover is caused to have a function as a filter holder at the same time by means of providing a filter for covering an opening portion at a tip end of the electrode holder in the electrode cartridge, in the fitting hole of the drop-off prevention cover.

10. The ionizer according to claim 3, wherein the drop-off prevention cover is caused to have a function as a filter holder at the same time by means of providing a filter for covering an opening portion at a tip end of the electrode holder in the electrode cartridge, in the fitting hole of the drop-off prevention cover.

* * * * *